United States Patent [19]

Matsuzaka et al.

[11] Patent Number: 4,591,549

[45] Date of Patent: May 27, 1986

[54] PROCESS FOR PREPARING SILVER HALIDE EMULSIONS

[75] Inventors: Syoji Matsuzaka, Hino; Makoto Kajiwara; Masanobu Miyoshi, both of Odawara; Kiyoshi Yamashita, Hino, all of Japan

[73] Assignee: Konishiroku Photo Industry Co., Ltd., Tokyo, Japan

[21] Appl. No.: 651,067

[22] Filed: Sep. 14, 1984

Related U.S. Application Data

[63] Continuation-in-part of Ser. No. 528,129, Aug. 31, 1983, abandoned.

[30] Foreign Application Priority Data

Sep. 8, 1982 [JP] Japan ..... 57-157170

[51] Int. Cl.[4] ..... G03C 1/02

[52] U.S. Cl. ..... 430/569; 430/567; 430/940

[58] Field of Search ..... 430/567, 569, 940

[56] References Cited

U.S. PATENT DOCUMENTS

| | | | |
|---|---|---|---|
| 4,075,020 | 2/1978 | Saleck et al. | 430/569 |
| 4,210,450 | 7/1980 | Corben | 430/569 |
| 4,251,627 | 2/1981 | Calamur | 430/569 |
| 4,339,532 | 7/1982 | Corben et al. | 430/569 |
| 4,414,306 | 11/1983 | Wey et al. | 430/569 |
| 4,497,895 | 2/1985 | Matsuzaka et al. | 430/567 |

*Primary Examiner*—Mary F. Downey

*Attorney, Agent, or Firm*—Frishauf, Holtz, Goodman & Woodward

[57] ABSTRACT

Improved process for preparing silver chlorobromide or silver chloroiodobromide emulsion wherein first silver ion solution and second halide ion solution are mixed by double jet method and mole % of silver bromide, silver chloride and silver iodide are in specified range, characterized in that molar ratio of $Br^-$:$Cl^-$:$I^-$ in second solution is within specified range and further step is included to produce silver halide with control of silver ion concentration by using third solution containing $Br^-$ and $Cl^-$. Such emulsions have sufficiently narrow grain diameter distribution and silver halide composition distribution, with constant productivity.

14 Claims, 1 Drawing Figure

PROCESS FOR PREPARING SILVER HALIDE EMULSIONS

Figure 1:
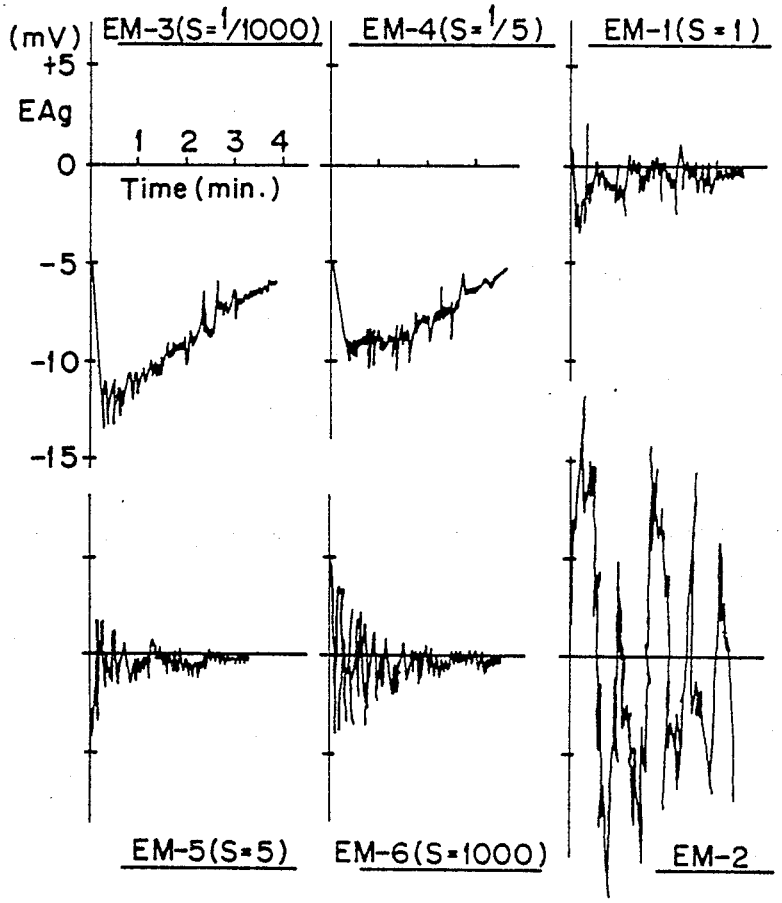

This application is a continuation-in-part of U.S. Ser. No. 528,129, filed 8/31/83, now abandoned.

This invention relates to a process for the preparation of a silver chlorobromide or silver chloroiodobromide emulsion.

More particularly, it is concerned with a process for preparing a silver chlorobromide or silver chloroiodobromide monodisperse emulsion having an improved controllability of a silver ion concentration and an excellent stability in production, as well as with a silver chlorobromide or silver chloroiodobromide monodisperse emulsion having a narrow silver halide composition distribution and a narrow grain size distribution of silver halide grains.

Generally, silver halide grains widely employed for a photographic material in the art have been formed as a silver halide emulsion by admixing under stirring an aqueous solution of a water-soluble silver halide with an aqueous solution of a water-soluble silver salt in the presence of a protective colloid such as gelatin. As such production procedures, there have been proposed a single jet mixing method, a double jet mixing method and so on. A single jet mixing method is to add with stirring an aqueous solution of a silver salt to an aqueous solution of a silver halide placed in a reaction vessel over a certain addition period to produce silver halide crystals. A double jet mixing method is to add with stirring an aqueous solution of a silver salt and an aqueous solution of a halide simultaneously over respective certain addition periods to a gelatin solution or a gelatin solution containing silver halide seed crystal placed in a reaction vessel to produce silver halide crystalline grains.

Those silver halide emulsions as prepared according to such various means are then subjected to chemical sensitization or color sensitization so as to exert desired photographic properties. It is dependent upon halogen composition, distortion of crystal structure, crystal habit, grain size and the like in individual silver halide crystal how such chemical or color sensitization could be accomplished and hence there is required for optimum chemical or color sensitization made throughout a silver halide emulsion a monodisperse emulsion in which each grain is of a certain shape, a grain diameter distribution is sufficiently narrow and halogen composition does not vary between or within grains.

Such a monodisperse emulsion could not be formed by the said single jet method or a double jet method without any controlling of pAg and then there have been extensively studied various controlled double jet methods wherein pH of a reaction solution, pAg thereof (logarithm of reciprocal of a silver ion concentration), addition rate and the like would be controlled when added.

As an example of such techniques, there may be mentioned the procedures as disclosed in Japanese Patent Published Application No. 48521/1979. Moreover, importance in pAg and its control when a silver halide emulsion is to be prepared will be also seen from the following prior art: Journal of Photographic Science, 12, 242–251(1964), 27, 47–53(1979) disclose that crystal habit and shape of silver halide depend upon pAg when prepared. As to differences in chemical ripening properties of the so-obtained silver halide emulsions having different crystal habits, many reports have been issued as seen in Journal of Photographic Science, 14, 181–184(1966) and others and it is apparent that pAg when prepared relates closely to photographic properties of the emulsion prepared therefrom. Journal of Photographic Science, 17, 1–12(1979) discloses solubility of silver halide depends upon pAg. Also, Bulletin of the Society of Scientific Photography of Japan, 16, 1–7(1966) and many other reports disclose that a growth rate of silver halide is proportional to solubility of silver halide. It will be also noted from these reports that pAg could be decisive to growth rate of silver halide in preparing a silver halide emulsion. Further, Japanese Patent Published Application No. 110926/1981 discloses that pAg, when silver iodobromide having a high content of silver iodide is to be prepared, may influence upon halogen composition distribution and grain size distribution.

As discussed above, it is requisite in the controlled double jet method to control pAg properly for reproductivity of emulsion preparation.

For controlling of pAg in preparing silver chlorobromide or silver chloroiodobromide according to the controlled double jet method, it has been previously adapted to control addition rate of at least either of a silver ion solution and a halide ion solution employed for production of silver halide crystals.

On the other hand, more rapid production of an emulsion in a shorter period of time is required from a productive standpoint and a silver ion solution and a halide ion solution are usually employed at a higher concentration. However, it is necessary for controlling pAg in a concentrated solution to slow down an addition speed or rate. Then, there has been desired an improvement for meeting the inconsistent requirement between slowness and speediness.

Moreover, a radical variation between a higher pAg state and a lower pAg state to the pAg to be controlled may repeatedly occur by the use of a high conc. solution. As set forth above, pAg may influence upon crystal growth speed, halogen composition distribution and grain size distribution and then silver halide composition distribution and grain size distribution may gradually be expanded during the varied pAg course repeating a higher pAg state and a lower pAg state, which does not lead to the production of a monodisperse emulsion having the desired narrow grain diameter distribution for its improvement being required.

And further, for controlling pAg in the preparation of a silver halide emulsion there has been proposed a method wherein a third solution for pAg control composed of a potassium bromide solution is applied, in addition to a silver ion solution and a halide ion solution for producing silver halide crystals. However, this method may provide the so-called conversion to replace the chloride ion within crystal by bromide ion and could not produce the desired silver halide composition.

In a silver halide photosensitive material, various photographic properties such as developability, sensitivity, contrast and the like may be greatly influenced by composition of silver halide. Then, silver halide composition may be controlled for the desired photographic properties, but any unnecessary properties may be frequently accompanied with the desired properties in a specified halide composition and a variety of means has been proposed for the desired photographic properties solely. One of such means is to change silver halide compositions at the surface and interior of silver halide crystal. This is believed to be effective in controlling photographic properties, but it is further required for developing such an effect to minimize variation in silver halide composition, grain size and grain shape and simultaneously from the desired silver halide composition at a specific site in grain.

And further, one of the methods for preparing silver chlorobromide or silver chloroiodobromide crystals having different silver halide compositions at the surface and interior of said crystals is a conversion method as disclosed in Japanese Patent Publication No. 36978/1975. The conversion method is to form a silver halide grain emulsion containing at least a portion of a silver salt, which has a higher solubility in water than that of silver bromide, and replace the silver halide in said emulsion by further addition of an aqueous solution of a water-soluble halide to form a more sparingly soluble silver salt than said silver halide. The emulsion formed according to such conversion method has different silver halide compositions at the surface and interior of crystal and a continuous change in silver halide composition is seen from a certain silver halide composition near the surface through a certain silver halide composition in the interior. However, said conversion method has restriction in controlling photographic properties; namely, it is difficult therein to avoid distortion of crystal lattice or to arrange more easily soluble silver halide toward the surface rather than in the core portion with regard to grain diameter.

Also, there has been well-known a method for an emulsion, i.e. a core/shell type emulsion comprising silver halide grains having different halogen compositions in the neighborhood of the surface and interior of crystal according to a double jet method using no third solution as done in this invention. This method is to control pAg with a halide ion solution having an approximately equal concentration to a silver ion concentration of a silver ion concentration so that a higher pAg state and a lower pAg state may be repeated by turns to pAg to be controlled. On the other hand, production of an emulsion should be desirably done in a shorter period of time and a silver ion solution and a halide solution, both of which have a very high concentration, are usually employed. Therefore, if control of pAg is to be effected with only a halide solution approximately equivalent to a silver ion solution, a higher pAg state and a lower pAg state to the pAg to be controlled are repeated and halogen composition distribution and grain size distribution may be gradually expanded so that it becomes difficult to form a monodisperse emulsion composed of crystals having discontinuously varied silver halide compositions from crystal surface toward the interior thereof.

It is, therefore, a primary object of this invention to provide a process for preparing a monodisperse silver chlorobromide or silver chloroiodobromide emulsion having a sufficiently narrow grain diameter distribution and individual silver halide grain of a constant shape.

A second object of this invention is to provide a monodisperse silver chlorobromide or silver chloroiodobromide emulsion having a desired silver halide composition distribution toward grain diameter of silver halide grain and a process for preparing the same.

A third object of this invention is to provide a process for preparing a monodisperse silver chlorobromide or silver chloroiodobromide emulsion with an excellent production stability.

A fourth object of this invention is to provide a monodisperse silver chlorobromide or silver chloroiodobromide emulsion composed of crystals wherein grain diameter distribution is remarkably narrow, individual silver halide grain is of a constant shape and silver halide composition discontinuously changes from crystal surface toward interior thereof, as well as a process for preparing the same.

These and other objects of this invention will become apparent from the following description.

The present inventors have now found that the above-mentioned objects can be accomplished by a process for preparing a silver halide emulsion and a silver halide emulsion produced by the said process according to this invention; more specifically, the present process is directed to a process for preparing a silver halide emulsion wherein a silver ion solution (a first solution) and a halide ion solution (a second solution) are admixed in the presence of a protective colloid according to a double jet method and silver bromide is a mole %, silver chloride is b mole % and silver iodide is c mole % (wherein $a>0$, $b>0$, $c\geqq 0$ and $a+b+c=100$), characterized in that a molar ratio of bromide ion: chloride ion: iodide ion in said second solution is a:kb:c (wherein $1\geqq k\geqq 0.9$) and there is further included a step to produce a silver halide while controlling a silver ion concentration by using a third solution containing a bromide ion and a chloride ion, in addition to said first and second solutions.

In an embodiment of this invention, a molar ratio of the chloride ion and bromide ion contained in said third solution, Y ($cl^-/Br^-$), should be preferably adopted to be a value as defined with $Y=KX$, wherein $40\leqq K\leqq 1200$ and X is Cl/Br (molar ratio) of the silver halide to be formed.

In a preferred embodiment of this invention, it is desirable that said admixing is carried out according to a premix method, a temperature for forming silver halide is 30°–70° C. and a pAg value is 4.0–9.0. A further embodiment is that silver iodide comprises not more than 2 mole %, silver bromide 50–97 mole % and silver chloride the remainder in a total amount of silver halide produced.

In embodiments of this invention for applying to such a silver halide emulsion having different silver halide compositions, e.g. silver halide grains in the form of two laminated layers, there may be mentioned the following embodiments, namely if said ratio of a:b:c is changed in two stages to define the first stage of a:b:c as $a_1:b_1:c_1$ and the second stage of a:b:c as $a_2:b_2:c_2$, $a_1+b_1+c_1$ is 100 and $a_2+b_2+c_2$ is 100, wherein $a_1$ and $a_2$ are individually a positive number and $b_1$, $c_1$, $b_2$ and $c_2$ are individually 0 or a positive number provided that both $b_1$ and $b_2$ are not simultaneously 0, and, when $b_1$ is 0, $c_1$ is 0 and, when $b_2$ is 0, $c_2$ is 0 provided that $c_1$ and $c_2$ may be 0 when $b_1$ and/or $b_2$ is other than 0. A number of such laminated layers is not restricted to the above two layers solely, but three or more layers may be optionally adopted. The embodiment for the said two layers may apply correspondingly to these embodiments.

The above-defined silver halide-producing step of this invention may be applied totally to the surface through the center part of silver halide grains or partly to any portion of grains. In the latter case, it is preferable to apply the step to any portion near the surface of silver halide grains.

The present characteristic step for producing silver halide is to grow silver halide crystals by producing a silver halide having a given silver halide composition ratio of a:b:c, while controlling pAg or EAg of an emulsion precisely and stably and supplying the chloride ion being insufficient in the second solution through a mutual interaction of chloride ion and bromide ion by simultaneous addition of the third solution with the first and second solutions. The present silver halide-producing step may be repeated several times or optionally repeated several times among other silver halide-producing steps, chemical ripening steps, washing steps and the like.

In this invention, the second solution may be of a mixed solution type wherein the required halides are previously mixed and dissolved at the prescribed molar ratio or of a simple solution type wherein each of halide solutions is added at the aforesaid mole % of a:kb:c. In the latter case, the said mole % may be optionally and continuously varied to continuously or discontinuously change a mole % of the produced silver halide and in this instance, the third solution should be formulated and applied with a simple two solution type of, e.g., a chloride solution and a bromide solution so as to make up the $Cl^-/Br^-$ correspondingly to change in molar ratio of the said second solution. Then, composition ratio of the silver halide thus precipitated and formed can be continuously or discontinuously varied at a controlled constant molar ratio with enough stability and high precision, with regard to any of silver chloride, silver bromide and silver iodide, by a stable and precise control of pAg with simultaneous addition of the third solution. In addition, said variation may be freely effected to higher or lower at any time and the present step may be subsequently applied so that any optional composition ratio may be constantly and certainly fixed toward the grain diameter of silver halide grains.

Accordingly, this invention can provide with a good reproducibility a monodisperse emulsion of a constant crystal shape wherein silver halide grains have a uniform silver halide composition ratio from the interior of emulsion grain up to the surface layer thereof or silver halide grains have a continuously varied composition ratio with the silver bromide-rich interior and silver bromide-poor surface layer therein or with the reverse thereof or the so-called core/shell type silver halide grains have definitely different composition ratios between the interior thereof and the surface layer thereof.

The third solution containing chloride ion and bromide ion as set forth hereinabove is added by controlling the concentration and/or addition rate thereof so as to sufficiently minimize change in pAg, when a total amount of halide approximately equal to a silver ion amount as added in the first solution is added by controlling the concentration and/or addition rate of the second solution. If the third solution is added at an addition rate approximately to that of the second solution, a concentration of the third solution should be preferably 1/10 or lower to a total halide ion concentration of the second solution and, if an addition rate could be fixed as 1/10 or lower, an equal concentration to a halide ion concentration of the second solution may be applicable.

When a solution of bromide ion (hereinafter referred to sometimes as $Br^-$) is employed in the third solution, the so-called conversion may occur to replace chloride ion (hereinafter referred to sometimes as $Cl^-$) within crystal by $Br^-$, which leads to not only production of silver chlorobromide crystal having a higher silver bromide content than that in the desired composition, but degradation of properties owing to silver halide crystal being pressured. It appears, therefore, reasonable to employ a $Cl^-$ solution as the third solution, since solubility product of silver chloride is far higher than that of silver bromide. However, if a $Cl^-$ solution is actually employed as the third solution for controlling EAg, a supplied amount of the first solution (for silver ion) is larger than or equal to that of the second solution (for silver halide ion) and, nevertheless, EAg may rapidly drop immediately after the addition of both solutions, thereby EAg control being impossible. In order to eliminate the above-depicted inconvenience, this invention can accomplish elimination of variation of composition due to conversion and precise and constant EAg control by the use of a mixed solution of both $Br^-$ and $Cl^-$ as the third solution.

Concentration ratio of $Cl^-$ and $Br^-$ on the third solution is preferably within the range as defined by the following formulae, depending upon temperatures applied and crystal compositions desired. More specifically, a preferable range of the molar ratio Y of a $Cl^-$ concentration to a $Br^-$ concentration ($Cl^-/Br^-$) in the third solution for controlling pAg in this invention can be defined by the formula:

$$Y=KX,$$

, where K is 40 to 1200 and X is Cl/Br (molar ratio) in the resultant silver halide. More preferably, a K value is within the range as determined by the following formula, depending upon temperatures of an emulsion base solution to produce and suspend silver halide:

$$K=(634.9-12.75t+0.07938t^2)\times S,$$

, where t is a temperature (°C.) of the emulsion base solution to produce and suspend silver halide and S is a positive number of 3 to $\frac{1}{3}$.

By applying the Y value thus determined to the third solution, control of pAg can be effected with a much more increased precision and stability and thus a higher monodisperse emulsion with a constant shape can be prepared in a better reproducibility with the desired silver halide composition being formed in a greater precision.

In the following description, pAg and EAg are numerically reverse and physical relationship between them is established, so that a silver ion concentration may be expressed optionally in terms of either pAg or EAg.

In the present invention, there is no limitation on procedures for admixing the first, second and third solutions, if the desired mixing could be achieved, but a higher mixing efficiency is more preferable. When a mixing efficiency is low, partial rise or drop of pAg may occur to vary monodispersability and emulsion properties.

However, the object of this invention can be much more satisfactorily accomplished by making use of a premix method with a higher mixing efficiency. The said premix method is meant, with particular reference to emulsion preparation, to be a method wherein a silver ion solution and a halide ion solution are poured and mixed and instantly homogenized in a rapidly cycled solution or a previously prepared emulsion, within a mixing field with a given volume in which there are being controlled such factors for mixing efficiency as flow rate, flowing direction, temperature, stirring exchange ratio and the like, and then discharged and mixed in a base solution out of said mixing field. A mixing stirrer which may be utilized for said premix method is disclosed, for example, in Japanese Patent Published Applications No. 92523/1982 and No. 92524/1982, and "Journal of Scientific and Photograph and Cinematography" 23, 64–75(1978) and so on.

The present process for preparing a silver chlorobromide or silver chloroiodobromide emulsion is not limited upon a temperature of emulsion. However, if a temperature is too low, growth speed of crystal becomes slow and, if too high, evaporation of water could not be negligible. It is then preferred to apply a temperature of 30°–70° C.

The pAg of an emulsion is not critical, but preferably 4.0 to 9.0, because photographic properties may sometimes be undesirable in the silver chlorobromide or silver chloroiodobromide emulsion prepared when a silver ion concentration or a bromide ion concentration is high, i.e. pAg is low or high.

This invention is directed to a silver chlorobromide or silver chloroiodobromide emulsion and mole % of silver chloride, silver bromide or silver iodide in a silver halide composition is not particularly critical. In view of properties of the resultant silver halide, it is particularly effective to apply to production of silver chlorobromide or silver chloroiodobromide wherein silver iodide is of not more than 2 mole %, silver bromide is of 50–97 mole % and the remainder is silver chloride.

As a protective colloid in this invention, there may be employed a water-soluble polymer, for example, natural or synthetic polymer such as gelatin or polyvinyl alcohol alone or in admixture therewith. A total amount of the protective colloid may be varied depending upon properties of the desired silver halide grain, conditions of production and the like, but one may optionally select any of the range from about 0.5 to about 100 g per liter of a solution.

Typical example of a silver ion solution which may be employed in this invention is silver nitrate solution. It may be employed in the form of a silver ammonium complex solution made by addition of not less than 2 moles of ammonia per mole of silver nitrate.

The halide ion which may be employed in this invention may be supplied in the form of its corresponding water-soluble halide compound. As examples of such halide compound, there may be employed potassium iodide, sodium iodide, potassium bromide, sodium bromide, ammonium bromide, potassium chloride, sodium chloride, ammonium chloride and the like.

Concentrations of a silver ion solution and a halide ion solution in this invention may be optionally selected depending upon the purposes and conditions for production, but a concentration of 0.5–3.0 mole/l may be preferably applied.

A monodisperse emulsion has better photographic properties such as higher sensitivity, lower fog and higher contrast as compared with a polydisperse emulsion containing twinned crystals, since the former can be subjected to chemical sensitization or color sensitization more uniformly and more optimally among the grains constituting the emulsion. Moreover, the fact that a monodisperse emulsion can provide high contrast results in an advantage that precious silver source can be saved since the same contrast, which has been attained with the conventional twinned crystal polydisperse emulsion, can be obtained with a smaller amount of silver.

One requisite for obtaining a monodisperse emulsion is to form a silver halide under conditions for not forming twinned crystals such as tabular grains, i.e., under conditions for forming regular crystals such as cubic, octahedral or tetradecahedral grains. Generally speaking, under a condition of higher halide ion concentration, i.e., of higher pAg value, tabular grains and/or other twinned crystal grains are formed, resulting in a polydisperse emulsion having a wide grain size distribution. On the other hand, under a condition of lower halide ion concentration, i.e., at lower pAg, formation of twinned crystals is little and a relatively monodispersed emulsion containing regular grains can be obtained.

Another requirement for obtaining a monodisperse emulsion is to grow crystals under conditions for uniform crystal growth by strictly controlling silver ion concentration, i.e., pAg.

Here, a monodisperse emulsion is referred to as an emulsion which contains silver halide grains having a coefficient of variation for grain size distribution of 15% or less.

The coefficient of variation is defined by the following equation.

$$\text{coefficient of variation (\%)} = \frac{\text{(standard deviation of grain size)} \times 100}{\text{(mean grain diameter)}}$$

The present inventors have provided a process for preparing a monodisperse silver chlorobromide or silver chloroiodobromide emulsion excellent in production stability, which comprises using a pAg adjusting solution (third solution) containing chloride ions and bromide ions at a specific composition ratio, in addition to a halide solution as a supply source of halide ions for silver halide crystals, to control the pAg.

The octahedral or tetradecahedral silver chlorobromide or silver chloroiodobromide emulsion produced by the process according to the present invention contains silver halide grains being of more uniform shape and having more narrow grain size distribution as compared with the emulsions produced by the conventional processes.

A high silver ion concentration, i.e., a condition of lower pAg is not preferable since fog tends to occur under such conditions. Therefore, in order to prepare a monodisperse emulsion of lower fog, the composition ratio of chloride ions and bromide ions ($Cl^-/Br^-$) in the above-mentioned third solution should be maintained at such a value as defined by the following equation $$Y = KX$$

wherein Y is the composition ratio of $Cl^-/Br^-$; K is 40 to 1200; and X is b/a, and, at the same time, the silver halide should be formed under a condition which does neither form twinned crystals nor exhibit fog, i.e., at a predetermined halogen ion concentration (i.e., a predetermined sum of chloride and bromide ion concentrations) of $3\times10^{-2}$ normal (N) through $1\times10^{-6}$ normal (N), preferably $1\times10^{-2}$ normal through $1\times10^{-5}$ normal, while a halide ion concentration can be converted into a pAg value, depending upon temperature and composition.

In the following Table, pAg values converted from halide ion concentrations are shown.

-continued

| Tem (°C.) | Composition ratio (molar ratio of Br/Cl) | Conversion of halide ion concentration into pAg: Halide ion ($Cl^- + Br^-$) concentration (normal) $1 \times 10^{-3}$ | $1 \times 10^{-2}$ | $1 \times 10^{-1}$ | 0.3 | 0.9 |
|---|---|---|---|---|---|---|
| 30° C. | 99/1 | 8.44 | 9.44 | 10.44 | 10.92 | 11.40 |
| " | 98/2 | 8.19 | 9.20 | 10.20 | 10.67 | 11.15 |
| " | 90/10 | 7.54 | 8.55 | 9.55 | 10.03 | 10.50 |
| " | 85/15 | 7.38 | 8.38 | 9.38 | 9.85 | 10.33 |
| " | 80/20 | 7.25 | 8.25 | 9.25 | 9.73 | 10.20 |
| " | 70/30 | 7.08 | 8.08 | 9.08 | 9.56 | 10.03 |
| " | 60/40 | 6.96 | 7.96 | 8.96 | 9.43 | 9.91 |
| " | 50/50 | 6.86 | 7.86 | 8.86 | 9.34 | 9.81 |
| 40° C. | 99/1 | 8.06 | 9.06 | 10.06 | 10.54 | 11.02 |
| " | 98/2 | 7.83 | 8.83 | 9.83 | 10.31 | 10.79 |
| " | 90/10 | 7.19 | 8.19 | 9.19 | 9.67 | 10.15 |
| " | 85/15 | 7.02 | 8.02 | 9.02 | 9.50 | 9.98 |
| " | 80/20 | 6.90 | 7.90 | 8.90 | 9.38 | 9.86 |
| " | 70/30 | 6.73 | 7.73 | 8.73 | 9.21 | 9.68 |
| " | 60/40 | 6.61 | 7.61 | 8.61 | 9.08 | 9.56 |
| " | 50/50 | 6.50 | 7.51 | 8.51 | 8.99 | 9.46 |
| 50° C. | 99/1 | 7.71 | 8.71 | 9.71 | 10.18 | 10.66 |
| " | 98/2 | 7.48 | 8.48 | 9.48 | 9.96 | 10.44 |
| " | 90/10 | 6.86 | 7.86 | 8.86 | 9.34 | 9.82 |
| " | 85/15 | 6.69 | 7.69 | 8.69 | 9.17 | 9.65 |
| " | 80/20 | 6.57 | 7.57 | 8.57 | 9.05 | 9.52 |
| " | 70/30 | 6.40 | 7.40 | 8.40 | 8.87 | 9.35 |
| " | 60/40 | 6.27 | 7.27 | 8.27 | 8.75 | 9.23 |
| " | 50/50 | 6.18 | 7.18 | 8.18 | 8.66 | 9.13 |
| 55° C. | 99/1 | 7.54 | 8.54 | 9.54 | 10.02 | 10.49 |
| " | 98/2 | 7.32 | 8.32 | 9.32 | 9.80 | 10.28 |
| " | 90/10 | 6.71 | 7.71 | 8.71 | 9.19 | 9.66 |
| " | 85/15 | 6.54 | 7.54 | 8.54 | 9.02 | 9.49 |
| " | 80/20 | 6.42 | 7.42 | 8.42 | 8.90 | 9.37 |
| " | 70/30 | 6.25 | 7.25 | 8.25 | 8.72 | 9.20 |
| " | 60/40 | 6.12 | 7.12 | 8.12 | 8.60 | 9.08 |
| " | 50/50 | 6.03 | 7.03 | 8.03 | 8.51 | 8.98 |
| 60° C. | 99/1 | 7.38 | 8.38 | 9.38 | 9.86 | 10.34 |
| " | 98/2 | 7.17 | 8.17 | 9.17 | 9.65 | 10.13 |
| " | 90/10 | 6.57 | 7.57 | 8.57 | 9.04 | 9.52 |
| " | 85/15 | 6.40 | 7.40 | 8.40 | 8.88 | 9.35 |
| " | 80/20 | 6.28 | 7.28 | 8.28 | 8.76 | 9.23 |
| " | 70/30 | 6.11 | 7.11 | 8.11 | 8.58 | 9.06 |
| " | 60/40 | 5.98 | 6.98 | 7.98 | 8.46 | 8.94 |
| " | 50/50 | 5.88 | 6.88 | 7.88 | 8.36 | 8.84 |
| 70° C. | 99/1 | 7.08 | 8.08 | 9.08 | 9.56 | 10.03 |
| " | 98/2 | 6.88 | 7.88 | 8.88 | 9.36 | 9.84 |
| " | 90/10 | 6.29 | 7.29 | 8.29 | 8.77 | 9.25 |
| " | 85/15 | 6.13 | 7.13 | 8.13 | 8.60 | 9.08 |
| " | 80/20 | 6.01 | 7.01 | 8.01 | 8.48 | 8.96 |
| " | 70/30 | 5.84 | 6.84 | 7.84 | 8.31 | 8.79 |
| " | 60/40 | 5.71 | 6.71 | 7.71 | 8.19 | 8.67 |
| " | 50/50 | 5.62 | 6.62 | 7.62 | 8.09 | 8.57 |

This invention will be more fully illustrated by way of the following examples, but they are not intended to be limiting the scope of this invention.

EXAMPLE 1

A chlorobromide emulsion having a silver bromide content of 70 mole % was prepared as the desired emulsion from the 7 solutions as defined below.

| | |
|---|---|
| Solution 1-A | |
| Ossein gelatin | 40 g |
| Distilled water | 4000 ml |
| 10% Ethanolic solution of polyisopropylene-polyethyleneoxy-disuccinic acid ester sodium salt in water | 10 ml |
| $AgNO_3$ | 170 mg |
| Solution 1-B | |
| $AgNO_3$ | 23 g |
| Distilled water to make up | 1350 ml |
| Solution 1-C | |
| $AgNO_3$ | 577 g |
| Distilled water to make up | 1700 ml |
| Solution 1-D | |
| Ossein gelatin | 27 g |
| KBr | 11.9 g |
| NaCl | 2.37 g |
| 10% Ethanolic solution of polyisoproplene-polyethyleneoxy-disuccinic acid ester sodium salt in water | 5 ml |
| 10% $H_2SO_4$ | 19 ml |
| Distilled water to make up | 1340 ml |
| Solution 1-E | |
| Ossein gelatin | 33 g |
| KBr | 289 g |
| NaCl | 59.5 g |
| 10% Ethanolic solution of polyisopropylene-polyethyleneoxy-disuccinic acid ester sodium salt in water | 6 ml |
| 10% $H_2SO_4$ | 18.5 ml |
| Distilled water to make up | 1700 ml |
| Solution 1-F | |
| KBr | 2.20 g |
| NaCl | 115.8 g |
| Distilled water to make up | 2000 ml. |

This Solution 1-F is a solution for controlling a silver ion concentration and has a molar ratio (K = 251, Y = 107) when S is set as 1.0 in the above-mentioned formula;

-continued

| |
|---|
| $Y = KX$ |
| $K = (634.9 - 12.75t + 0.07938^2) \times S$ |
| Solution 1-G |
| 10-fold diluted aqueous solution of the Solution 1-F |

To the Solution 1-A were added over an addition period of 29.5 minutes the Solutions 1-B and 1-D by using a mixing stirrer as disclosed in our co-pending Japanese Provisional Patent Publications Nos. 92523/1982 and 92524/1982 according to a double jet method. As shown in Table 1, an addition rate was increased stepwise as an addition time passed. After 2 minutes from completion of the addition, the Solutions 1-C and 1-E were added over an addition period of 83 minutes according to a double jet method. An addition rate was increased stepwise as an addition period passed as shown in Table 1.

During the addition periods of the Solutions 1-B and 1-D and of the Solutions 1-C and 1-E, a pAg value of the Solution 1-A was adjusted to 7.5 (EAg value+228 mV) by using the Solution 1-G and the Solution 1-F, respectively. EAg value was measured by means of a metallic silver electrode and a double junction-type saturation Ag/AgCl comparison electrode. Addition of the Solutions 1-B, 1-C, 1-D and 1-E was effected with a flow-adjustable roller tube pump having a flow-adjustable range of 2 ml/min. to 80 ml/min. Also, addition of the Solutions 1-G and 1-F was done with a flow-adjustable roller tube pump having a flow-adjustable range of 0.1 ml/min. to 4 ml/min.

After 3 minutes from completion of the addition of the Solutions 1-C and 1-E, EAg value was adjusted to +70 mV with the Solution 1-E.

Then, washing and desalting were carried out as set forth below:

As a precipitating agent, there were added 650 ml of a 5% aqueous solution of "Demol N" (manufactured by Kao-Atlas K.K., Japan) and 650 ml of a 20% aqueous solution of magnesium sulfate to produce a precipitate in situ and then the precipitate was settled by standing and a supernatant decanted. Redispersion was conducted by addition of 7000 ml of distilled water. A precipitate was again formed by addition of 200 ml of a 20% aqueous solution of magnesium sulfate. After the precipitate was settled, a supernatant was decanted, 500 ml of an aqueous solution of ossein gelatin (containing 50 g of ossein gelatin) were added thereto and then dispersed by stirring at 55° C. for 30 minutes. A total volume was made up to 2500 ml with distilled water. The so-obtained emulsion is referred to hereinafter as "EM-1". Electron-microscopic observation showed that the emulsion is composed of cubic grains with a side length of 0.18 μm and a high monodisperse emulsion having a standard deviation of grain size distribution of 6.7% upon an average grain size.

TABLE 1

| Time (min.) | Addition rate (ml/min.) Solution 1-B | Solution 1-D | Solution 1-C | Solution 1-E |
|---|---|---|---|---|
| 0 | 10 | 9.7 | — | — |
| 3 | 10 | 9.7 | — | — |
| 5 | 15.9 | 15.4 | — | — |
| 7 | 22.7 | 22.0 | — | — |
| 10 | 36.4 | 35.3 | — | — |
| 12.5 | 50 | 48.5 | — | — |
| 15 | 53.6 | 61.7 | — | — |
| 29.5 | 63.6 | 61.7 | — | — |

TABLE 1-continued

| Time (min.) | Addition rate (ml/min.) Solution 1-B | Solution 1-D | Solution 1-C | Solution 1-E |
|---|---|---|---|---|
| 31.5 | — | — | 3.64 | 3.56 |
| 40 | — | — | 5.45 | 5.35 |
| 50 | — | — | 8.91 | 8.73 |
| 60 | — | — | 12.7 | 12.5 |
| 70 | — | — | 16.8 | 16.5 |
| 80 | — | — | 22.3 | 21.8 |
| 90 | — | — | 28 | 27.4 |
| 100 | — | — | 34.5 | 33.9 |
| 114.5 | — | — | 45 | 44.1 |

Following the same procedures as above for the EM-1 except that pAg was controlled with adjustment of flow rate of Solutions 1-D and 1-E without using of the above-mentioned Solutions 1-F and 1-G, a comparative emulsion without a third solution was prepared and is referred to hereinafter as "EM-2". Electron-microscopic observation showed that the emulsion is composed of cubic grains with a side length of 0.21 μm and a polydisperse emulsion having a standard deviation of grain size distribution of 18% upon an average grain size.

Moreover, by using Solutions 1-Fa–1-Ff and Solutions 1-Ga–1-Gf shown in Table 2 instead of the Solutions 1-F and 1-G in the EM-1, there were prepared emulsions by varying the composition ratio ($Cl^-/Br^-$) of the third solution, and are referred to thereinafter as EM-3–EM-8.

TABLE 2

| Solution | Emulsion | S | KBr | NaCl | Distilled water |
|---|---|---|---|---|---|
| 1-Fa | EM-3 | 1/1000 | 215 g | 11.3 g | made up to 2000 ml |
| 1-Fb | EM-4 | 1/5 | 5.2 g | 112 g | made up to 2000 ml |
| 1-Fc | EM-5 | 5 | 0.44 g | 117 g | made up to 2000 ml |
| 1-Fd | EM-6 | 1000 | 0.22 g | 117 g | made up to 2000 ml |
| 1-Fe | EM-7 | 0/1 | 238 g | 0 g | made up to 2000 ml |
| 1-Ff | EM-8 | 1/0 | 0 g | 116.8 g | made up to 2000 ml |
| 1-Ga | EM-3 | 1/1000 | 21.5 g | 1.13 g | made up to 2000 ml |
| 1-Gb | EM-4 | 1/5 | 0.52 g | 1.12 g | made up to 2000 ml |
| 1-Gc | EM-5 | 5 | 0.044 g | 1.17 g | made up to 2000 ml |
| 1-Gd | EM-6 | 1000 | 0.022 g | 1.17 g | made up to 2000 ml |
| 1-Ge | EM-7 | 0/1 | 238 g | 0 g | made up to 2000 ml |
| 1-Gf | EM-8 | 1/0 | 0 g | 11.68 g | made up to 2000 ml |

Then, a silver halide composition of the EM-1–EM-8 was determined by an X-ray diffraction method. Controlling of EAg values during preparation is illustrated in FIG. 1, wherein abscissa represents time and ordinate represents EAg (mV).

Maximum deviation EAg values in EAg controlling, silver halide compositions determined by X-ray diffraction and monodisperse ratios determined upon electron-microscopic photography (percentage of deviation of grain size to average grain size) are summarized in Table 3.

As can be seen from Table 3, a good controlling of EAg is further feasible with a mixed halide solution as the third solution to give an excellent monodisperse emulsion. When the K value which determines the composition ratio ($Cl^-/Br^-$) in the third solution of the present invention is within the scope of the present invention, EAg controlling or monodispersability can be favourable without any change in composition seen, thereby producing a desired emulsion.

TABLE 3

| Emulsion Name | Production | EAg controlling (Max. deviation) | Halide composition (X-ray diffraction) | Monodisperability (standard deviation/average grain size × 100) | K |
|---|---|---|---|---|---|
| EM-1 | Not within this invention 3rd soln. S = 1.0 | 2 mV | Br:Cl= 70:30 | 6.7% | 251 |
| EM-2 | Not within this invention 3rd soln. not used | 15 mV | Br:Cl= 70:30 | 18% | — |
| EM-3 | Not within this invention 3rd soln. S = 1/1000 | 13 mV | Br:Cl= 70:30 | 15% | 0.251 |
| EM-4 | Not within this invention 3rd soln. S = 1/5 | 10 mV | Br:Cl= 70:30 | 12% | 50 |
| EM-5 | Not within this invention 3rd soln. S = 5 | 2 mV | Br:Cl= 75:25 | 7.0% | 1250 |
| EM-6 | Not within this invention 3rd soln. S = 1000 | 3 mV | Br:Cl= 86:14 | 7.3% | $2.51 \times 10^5$ |
| EM-7 | Not within this invention 3rd soln. S = 0/1 | 14 mV | Br:Cl= 70:30 | 17% | 0 |
| EM-8 | Not within this invention 3rd soln. S = 0/1 | 2 mV | Br:Cl= 88:12 | 7.1% | — |

EXAMPLE 2

Silver chlorobromide seed emulsions having a silver bromide content of 60 mole % were prepared by using the 7 sorts of Solutions as defined below.

| | |
|---|---|
| Solution 2-A | |
| Ossein gelatin | 40 g |
| Distilled water | 4000 ml |
| 10% Ethanolic solution of polyisopropylene-polyethyleneoxy-disuccinic acid ester sodium salt in water | 10 ml |
| $AgNO_3$ | 170 g |
| 10% $H_2SO_4$ | 35 ml |
| Solution 2-B | |
| $AgNO_3$ | 23 g |
| Distilled water to make up | 1350 ml |
| Solution 2-C | |
| $AgNO_3$ | 577 g |
| Distilled water to make up | 1700 ml |
| Solution 2-D | |
| Ossein gelatin | 27 g |
| KBr | 10.07 g |
| NaCl | 3.13 g |
| 10% Ethanolic solution of polyisopropylene-polyethyleneoxy-disuccinic acid ester sodium salt in water | 5 ml |
| 10% $H_2SO_4$ | 19 ml |
| Distilled water to make up | 1340 ml |
| Solution 2-E | |
| Ossein gelatin | 33 g |
| KBr | 248 g |
| NaCl | 79.5 g |
| 10% Ethanolic solution of polyisopropylene-polyethyleneoxy-disuccinic acid ester sodium salt in water | 6 ml |
| 10% $H_2SO_4$ | 18.5 ml |
| Distilled water to make up | 1700 ml |
| Solution 2-F | |
| KBr | 1.42 g |
| NaCl | 116.2 g |
| Distilled water to make up | 2000 ml |
| Solution 2-G | |
| 7% Aqueous solution of sodium carbonate | 208 ml |

To the Solution 2-A were added over an addition period of 29.5 minutes the Solutions 2-B and 2-D by using a mixing stirrer as disclosed in our co-pending Japanese Provisional Patent Publications Nos. 92523/1982 and 92524/1982 according to a double jet method. As shown in Table 4, an addition rate was increased stepwise as an addition time passed. After 2 minutes from completion of the addition, the Solutions 2-C and 2-E were added over an addition period of 83 minutes according to a double jet method. An addition rate was increased as an addition period passed as shown in Table 4.

TABLE 4

| Time (min.) | Addition rate (ml/min.) Solution 2-B | Solution 2-D | Solution 2-C | Solution 2-E |
|---|---|---|---|---|
| 0 | 10 | 9.7 | — | — |
| 3 | 10 | 9.7 | — | — |
| 5 | 15.9 | 15.4 | — | — |
| 7 | 22.7 | 22.0 | — | — |
| 10 | 36.4 | 35.3 | — | — |
| 12.5 | 50 | 48.5 | — | — |
| 15 | 63.6 | 61.7 | — | — |
| 29.5 | 63.6 | 61.7 | — | — |
| 31.5 | — | — | 3.64 | 3.56 |
| 40 | — | — | 5.45 | 5.35 |
| 50 | — | — | 8.91 | 8.73 |
| 60 | — | — | 12.7 | 12.5 |
| 70 | — | — | 16.8 | 16.5 |
| 80 | — | — | 22.3 | 21.8 |
| 90 | — | — | 28 | 27.4 |
| 100 | — | — | 34.5 | 33.9 |
| 114.5 | — | — | 45 | 44.1 |

During the addition periods of the Solutions 2-B and 2-D and of the Solutions 2-C and 2-E, a pAg value of the Solution 2-A was adjusted to 4.6 (EAg value +340 mV) by using the Solution 2-F. EAg value was measured by means of a metallic silver electrode and a double junction-type saturation Ag/AgCl comparison electrode. Addition of the Solutions 2-B, 2-C, 2-D, 2-E and 2-F was effected with a flow-adjustable roller tube pump.

After 3 minutes from completion of the addition of the Solutions 2-C and 2-E, EAg value was adjusted to +70 mV with the Solution 2-F. Then, the Solution 2-G was added after 2 minutes.

Then, washing and desalting were carried out as set forth below:

As a precipitating agent, there were added 650 ml of a 5% aqueous solution of "Demol N" (manufactured by Kao-Atlas K.K., Japan) and 650 ml of a 20% aqueous solution of magnesium sulfate to produce a precipitate in situ and then the precipitate was settled by standing and a supernatant decanted. Redispersion was conducted by addition of 7000 ml of distilled water. A precipitate was again formed by addition of 200 ml of a 20% aqueous solution of magnesium sulfate. After the precipitate was settled, a supernatant was decanted, 500 ml of an aqueous solution of ossein gelatin (containing 50 g of ossein gelatin) were added thereto and then dispersed by stirring at 55° C. for 30 minutes. A total volume was made up to 2500 ml with distilled water. The so-obtained emulsion is referred to hereinafter as "EM-10". Electron-microscopic observation showed that the emulsion is composed of cubic grains with a side length of 0.144 μm and a high monodisperse emulsion having a standard deviation of grain size distribution of 6.3% upon an average grain size.

EXAMPLE 3

By using the 6 sorts of the Solutions as defined below, the said EM-10 was grown as a seed emulsion and there was prepared a core/shell type monodisperse emulsion of $S_1=1$ and $S_2=1$ in the above-given formula according to this invention.

| | |
|---|---|
| Solution 3-A | |
| Ossein gelatin | 31.9 g |
| Distilled water | 5666 ml |
| 10% Ethanolic solution of polyisopropylene-polyethyleneoxy-disuccinic acid ester sodium salt in water | 6.5 ml |
| EM-10 (seed emulsion) | 827.5 ml |
| Solution 3-B | |
| $AgNO_3$ | 1000 g |
| Distilled water to make up 1963 ml | |
| Solution 3-C ($X_1$ = 40/60) | |
| Ossein gelatin | 26.2 g |
| KBr | 295 g |
| NaCl | 91.76 g |
| 10% Ethanolic solution of polyisopropylene-polyethyleneoxy-disuccinic acid ester sodium salt in water | 2.62 ml |
| Distilled water to make up | 1308 ml |
| Solution 3-D ($X_2$ = 10/90) | |
| Ossein gelatin | 13.1 g |
| KBr | 221.2 g |
| NaCl | 11.47 g |
| 10% Ethanolic solution of polyisopropylene-polyethyleneoxy-disuccinic acid ester sodium salt in water | 1.31 ml |
| Distilled water to make up | 654 ml |
| Solution 3-E ($S_1$ = 1) | |
| KBr | 2.17 g |
| NaCl | 115.8 g |
| Distilled water | 2000 ml |
| Solution 3-F ($S_2$ = 1) | |
| KBr | 12.47 g |
| NaCl | 110.8 g |
| Distilled water | 2000 ml |

To the Solution 3-A were added at 60° C. the Solutions 3-B and 3-C by using a mixing stirrer as disclosed in our co-pending Japanese Provisional Patent Publications Nos. 92523/1982 and 92524/1982 over an addition period of 42.8 minutes according to a double jet method to form a silver chlorobromide core containing 60 mole % of silver bromide. Subsequently to the addition, the Solutions 3-B and 3-D were added over an addition period of 12.69 minutes according to a double jet method to form a shell layer containing 90 mole % of silver bromide.

TABLE 5

| Time (min.) | Addition rate (ml/min.) Solution 3-B | Solution 3-C | Solution 3-D |
|---|---|---|---|
| 7.00 | 17.52 | 16.64 | — |
| 2.73 | 18.94 | 17.99 | — |
| 5.27 | 20.30 | 19.29 | — |
| 7.65 | 21.61 | 20.53 | — |
| 12.01 | 24.13 | 22.92 | — |
| 17.78 | 27.68 | 26.30 | — |
| 22.88 | 31.01 | 29.46 | — |
| 27.46 | 34.17 | 32.46 | — |
| 31.65 | 37.19 | 35.33 | — |
| 36.74 | 41.03 | 38.98 | — |
| 40.26 | 43.80 | 41.61 | — |
| 42.80 | 45.88 | 43.59 | 43.59 |
| 46.69 | 49.09 | — | 46.63 |
| 51.55 | 53.28 | — | 50.62 |
| 55.49 | 66.77 | — | 53.93 |

An addition rate was increased stepwise as an addition period passed as shown in Table 5.

During the formation of a silver halide precipitate, a pAg value of the Solution 3-A was controlled to be kept at 7.5 (EAg value +107 mV) by using the Solution 3-E (during the addition of the Solution 3-C) and the Solution 3-F (during the addition of the Solution 3-D). A pAg value was determined in the same manner as in Example 1.

Addition of the Solutions 3-B, 3-C, 3-D, 3-E and 3-F was effected with a flow-adjustable roller tube pump.

After completion of the addition of the Solutions 3-C and 3-D, washing and desalting were carried out as set forth below:

As a precipitating agent, there were added 1300 ml of a 5% aqueous solution of "Demol N" (manufactured by Kao-Atlas K.K., Japan) and 1300 ml of a 20% aqueous solution of magnesium sulfate to produce a precipitate in situ and then the precipitate was settled by standing and a supernatant decanted. Redispersion was conducted by addition of 12300 ml of distilled water. A precipitate was again formed by addition of 400 ml of a 20% aqueous solution of magnesium sulfate. After the precipitate was settled, a supernatant was decanted, 800 ml of an aqueous solution of ossein gelatin (containing 80 g of ossein gelatin) were added thereto and then dispersed by stirring at 40° C. for 20 minutes. A total volume was made up to 5000 ml with distilled water. The so-obtained emulsion is referred to hereinafter as "EM-20". Electron-microscopic observation showed that the emulsion is composed of cubic grains with a side length of 0.51 μm and a high monodisperse emulsion having a standard deviation of grain size distribution of 6.9% upon an average grain size. Also, X-ray diffraction showed that the said emulsion is composed of two layers of 60 mole % silver bromide and of 90 mole % silver bromide. Further, immediately after the addition of the Solutions 3-C and 3-D, there was obtained a good EAg controllability.

EXAMPLE 4

By using the 5 sorts of the Solutions as defined below, the said EM-10 was grown as a seed emulsion and there was prepared a core/shell type monodisperse silver chlorobromide emulsion of $S_1=1.559$ and $S_2=0.5827$ in the above-given formula according to this invention.

| | |
|---|---|
| Solution 4-A | |
| Ossein gelatin | 31 g |
| Distilled water | 566.6 ml |
| 10% Ethanolic solution of polyisopropylene-polyethyleneoxy-disuccinic acid ester sodium salt | 6.5 ml |
| EM-10 (seed emulsion) | 827.5 ml |
| Solution 4-B | |
| $AgNO_3$ | 1000 g |
| Distilled water to make up | 1963 ml |
| Solution 4-C | |
| Ossein gelatin | 26.2 g |
| KBr | 295 g |
| NaCl | 91.76 g |
| 10% Ethanolic solution of polyisopropylene-polyethyleneoxy-disuccinic acid ester sodium salt in water | 2.62 ml |
| Distilled water to make up | 1308 ml |
| Solution 4-D | |
| Ossein gelatin | 13.1 g |
| KBr | 196.6 g |
| NaCl | 22.94 g |
| 10% Ethanolic solution of polyisopropylene-polyethyleneoxy-disuccinic acid ester sodium salt in water | 1.31 ml |
| Distilled water to make up | 654 ml |
| Solution 4-E ($S_1$ = 1.559, $S_2$ = 0.5827) | |
| KBr | 3.365 g |
| NaCl | 115.2 g |
| Distilled water | 2000 ml |

To the Solution 4-A were added the Solutions 4-B and 4-C at 60° C. over an addition period of 43.12 minutes by using a mixing stirrer as disclosed in our copending Japanese Provisional Patent Publications Nos. 92523/1982, and 92524/1982 according to a double jet method to form a silver chlorobromide core containing 60 mole % silver bromide. Subsequently to completion of the addition, the Solutions 4-B and 4-D were added over an addition period of 12.89 minutes according to a double jet method to form a shell layer containing 80 mole % silver bromide. An addition rate was increased stepwise as an addition time passed. The pAg value of the Solution 4-A was controlled to be kept at 7.5(EAg value +107 mV) by using the Solution 4-E during the addition of respective Solutions. pAg value was determined in the same manner as in Example 1. After completion of the addition, desalting and redispersing were effected in the same manner as in Example 3. The so-obtained emulsion is referred to hereinafter as "EM-30". Electron microscopic photograph showed that the EM-30 emulsion is composed of cubic grains with a side length of 0.50 μm and a high monodisperse emulsion having a standard deviation of grain size distribution of 8.7%. Also, X-ray diffraction showed that the emulsion is composed of two layers of 60 mole % silver bromide and of 80 mole % silver bromide. Further, immediately after the addition of Solutions 4-C and 4-D, there was obtained a good EAg controllability.

EXAMPLE 5

Emulsions as shown below were prepared at 60° C. in the same manner as in Examples 1 and 2 by varying the solid halide composition and the halide ion concentration {S=1; (K=155.7)}.

The shape and the grain size distribution of silver halide grains in each emulsion were investigated by electromicroscopic observation.

Separately, 2.5 g of a magenta coupler (Compound C shown hereinafter) was dissolved, under heating at 60° C., in a mixed solution of 2.5 ml of dibutyl phthalate and 7.5 ml of ethyl acetate, and the thus obtained solution was added to 70 ml of an aqueous solution at 40° C. which contained 3.5 g of gelatin and 0.25 g of sodium dodecylbenzenesulfonate. The resulting mixture was dispersed by vigorous stirring with a homogenizer to prepare a emulsified dispersion of the coupler.

The thus obtained emulsified dispersion of the coupler was admixed with 1 mole of each of the above-mentioned silver chlorobromide emulsions. To the resulting mixture was added 10 ml of a 3% methanolic solution of 1,3,5-triacryloyl-hexahydro-s-triazine, and then the final pH of the emulsion was adjusted to 6.2. The resulting emulsion was coated on a polyester substrate so that the amounts of silver, gelatin and the magenta coupler might be 0.3 g/m², 1.7 g/m² and 0.41 g/m² (80% of stoichiometric amount), respectively, to prepare Samples 1, 3 and 5.

Sensitizing dye (Compound A)

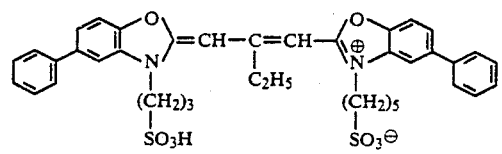

Stabilizer (Compound B)

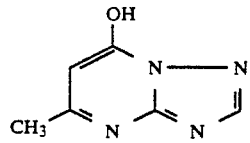

Magenta coupler (Compound C)

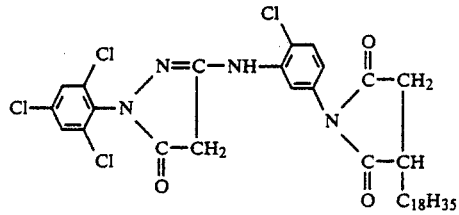

The above-mentioned Samples were subjected to color development according to the procedure shown below, followed by the measurement of properties.

| Treatment Step | Temperature | Time |
|---|---|---|
| Color development | 30° C. | 3 min. |
| Stopping | 30° C. | 1 min. |
| Fixing | 30° C. | 2 min. |
| Water washing | 30° C. | 2 min. |
| | (measurement of silver amount) | |
| Breach-fixing | 30° C. | 2 min. |
| Water washing | 30° C. | 2 min. |
| | (measurement of color density) | |

| (Composition of color developer) | |
|---|---|
| Sodium carbonate anhydrous | 2.6 g |
| Sodium bicarbonate anhydrous | 3.5 g |
| Potassium sulfite | 18 g |
| Sodium chloride | 0.2 g |
| Potassium bromide | 1.3 g |
| Potassium hydroxide | 0.4 g |
| Hydroxylamine sulfate | 2 g |
| 4-Amino-3-methyl-N—ethyl-N—(β-methanesulfonamidethyl)-aniline | 5 g |
| Make up to 1 l with the addition of water (pH 10.2) | |

-continued

| | |
|---|---|
| (Stopping solution) | |
| 2% aqueous solution of acetic acid | |
| (Fixing solution) | |
| Ammonium thiosulfate | 175.0 g |
| Sodium sulfite anhydrous | 8.6 g |
| Sodium metasulfite | 2.3 g |
| Make up to 1 l, and adjusted to pH 6.0 by using acetic acid | |
| (Breach-fixing solution) | |
| Ammonium thiosulfate | 100 g |
| Potassium sulfite | 5 g |
| Na[Fe (EDTA)] | 40 g |
| Make up to 1 l with the addition of water | |

Following the same procedure as in Example 1, monodispersability, shape of grain and fog density (green light density) were measured by using a transmission type densitometer PDA (manufactured by Konishiroku Photo. Ind. Co., Ltd.).

The results of the measurements are shown in the following Table 6.

TABLE 6

| composition ratio (molar) ratio of Br/Cl) | halide ion concent-ration | pAg | monodisper-sability (coefficient of variation) | shape | fog density by color development | outside or within the scope of the present invention |
|---|---|---|---|---|---|---|
| 90/10 | 0.9 (normal) | 9.52 | 28% | mainly twinned cyrstal | 0.02 | outside |
| 90/10 | 0.3 | 9.04 | 16 | mainly twinned cystal | 0.02 | outside |
| 90/10 | $3 \times 10^{-2}$ | 8.07 | 12.3 | tetra-deca-hedral | 0.02 | within |
| 90/10 | $1 \times 10^{-2}$ | 7.57 | 9.8 | cubic | 0.02 | within |
| 90/10 | $3 \times 10^{-3}$ | 7.07 | 9.1 | cubic | 0.02 | within |
| 90/10 | $1 \times 10^{-3}$ | 6.57 | 8.8 | cubic | 0.02 | within |
| 90/10 | $1 \times 10^{-4}$ | 5.57 | 9.0 | cubic | 0.02 | within |
| 90/10 | $1 \times 10^{-6}$ | 4.57 | 8.1 | cubic | 0.04 | within |
| 90/10 | $1 \times 10^{-7}$ | 3.57 | 8.5 | cubic | 0.10 | outside |
| 70/30 | 0.9 | 9.06 | 26 | mainly twinned crystal | 0.02 | outside |
| 70/30 | 0.3 | 8.58 | 18 | mainly twinned crystal | 0.02 | outside |
| 70/30 | $3 \times 10^{-2}$ | 8.59 | 11.2 | tetra-deca-hedral | 0.02 | within |
| 70/30 | $1 \times 10^{-2}$ | 7.11 | 9.5 | cubic | 0.02 | within |
| 70/30 | $1 \times 10^{-3}$ | 6.11 | 8.7 | cubic | 0.02 | within |
| 70/30 | $1 \times 10^{-4}$ | 5.11 | 6.5 | cubic | 0.03 | within |
| 70/30 | $1 \times 10^{-6}$ | 4.11 | 9.3 | cubic | 0.05 | within |
| 70/30 | $1 \times 10^{-7}$ | 3.11 | 8.7 | cubic | 0.15 | outside |
| 50/50 | 0.9 | 8.84 | 30 | mainly twinned crystal | 0.02 | outside |
| 50/50 | 0.3 | 8.36 | 20 | mainly twinned crystal | 0.02 | outside |
| 50/50 | $3 \times 10^{-2}$ | 7.36 | 10.5 | cubic | 0.02 | within |
| 50/50 | $1 \times 10^{-2}$ | 6.88 | 8.8 | cubic | 0.02 | within |
| 50/50 | $1 \times 10^{-3}$ | 5.88 | 6.2 | cubic | 0.02 | within |
| 50/50 | $1 \times 10^{-4}$ | 4.88 | 7.5 | cubic | 0.05 | within |
| 50/50 | $1 \times 10^{-6}$ | 3.88 | 1 | cubic | 0.08 | within |
| 50/50 | $1 \times 10^{-7}$ | 2.88 | 8.8 | cubic | 0.40 | outside |

As seen from the Table, it may be found that, even if S is 1, the grain size distribution becomes wider under such a higher pAg condition as form twinned crystals, and the desired monodisperse emulsion can not be obtained.

Further, it may be understood that, in case when the pAg is too low, fog is caused due to higher silver ion concentration, thus being not preferred.

We claim:

1. In a process for preparing a silver halide emulsion comprising a mole % of silver bromide, b mole % of silver chloride and c mole % of silver iodide, where $a>0$, $b>0$, $c \geqq 0$ and $a+b+c=100$, wherein a silver ion first solution and a halide ion first solution are mixed in the presence of a protective colloid according to a double jet method, the improvement wherein a molar ratio of bromide ion: chloride ion: iodide ion in said second solution is a:kb:c, where $1 \geqq k \geqq 0.9$, and said process further includes a step to produce silver halide emulsion, while controlling the concentration of the halide ions in the system obtained by mixing said first and second solutions at $3 \times 10^{-2}$ normal through $1 \times 10^{-6}$ normal by using a third solution containing chloride ions and bromide ions at a molar ratio Y ($Cl^-/Br^-$) defined by the following formula:

$$Y=KX$$

wherein K is 40 to 1200 and X is b/a.

2. A process according to claim 1 wherein the pAg value when the silver halide is prepared by said first and second solutions is in the range of 4.0 to 9.0.

3. A process according to claim 2 wherein said K is a value within the range as defined by the following formula:

$$K=(634.9-12.75t+0.07938t^2)\times S,$$

where t is a temperature (°C.) of an emulsion at producing a silver halide crystals and S is a positive number of 3 to $\frac{1}{3}$.

4. A process according to claim 1 wherein a temperature when silver halide is prepared is 30°–70° C. and a pAg value is 4.0–9.0.

5. A process according to claim 1 wherein said silver halide emulsion comprises not more than 2 mole % of silver iodide, 50–97 mole % of silver bromide and the remainder in a total amount of silver halide produced of silver chloride.

6. A process according to claim 1 wherein said silver halide emulsion contains core/shell type silver halide grains.

7. A process according to claim 1 wherein said protective colloid is gelatin or polyvinyl alcohol and is applied in a total amount of 0.5–100 g per liter of said solution.

8. A process according to claim 1 wherein said silver ion solution is an aqueous solution of silver nitrate or an aqueous solution of silver ammonium complex derived from silver nitrate and ammonia at a molar ratio of 1:2 or more.

9. A process according to claim 1 wherein said halide ion solution is an aqueous solution of potassium iodide, sodium iodide, potassium bromide, sodium bromide, ammonium bromide, potassium chloride, sodium chloride or ammonium chloride.

10. A process according to claim 1 wherein said silver ion solution has a concentration of 0.5–3.0 mole/l.

11. A process according to claim 1 wherein said halide ion solution has a concentration of 0.5–3.0 mole/l.

12. A process according to claim 1, wherein the mole percentages of a, b and c values of the second solution are continuously changed with the lapse of time.

13. A process according to claim 1, wherein the pAg is increased, with the lapse of time, within a range of 6.5 to 9.0.

14. A process according to claim 1 wherein said silver halide emulsion is a monodisperse emulsion.

* * * * *